US007764233B2

(12) United States Patent
Wu

(10) Patent No.: US 7,764,233 B2
(45) Date of Patent: Jul. 27, 2010

(54) SYMMETRICAL UNI-PLATED ANTENNA AND WIRELESS NETWORK DEVICE HAVING THE SAME

(75) Inventor: Jung Tai Wu, Taipei (TW)

(73) Assignee: Cameo Communications Inc. (TW)

( * ) Notice: Subject to any disclaimer, the term of this patent is extended or adjusted under 35 U.S.C. 154(b) by 0 days.

(21) Appl. No.: 11/790,303

(22) Filed: Apr. 24, 2007

(65) Prior Publication Data

US 2008/0266180 A1 Oct. 30, 2008

(51) Int. Cl.
*H01Q 1/38* (2006.01)

(52) U.S. Cl. ..... 343/700 MS; 343/702; 343/767; 343/846

(58) Field of Classification Search ..... 343/700 MS, 343/702, 767, 770, 846
See application file for complete search history.

(56) References Cited

U.S. PATENT DOCUMENTS 6,295,030 B1 * 9/2001 Kozakai et al. ..... 343/700 MS
6,549,169 B1 * 4/2003 Matsuyoshi et al. ..... 343/702
7,193,571 B2 * 3/2007 Inatsugu et al. ..... 343/702
7,339,536 B2 * 3/2008 Hung et al. ..... 343/702

* cited by examiner

*Primary Examiner*—Hoang V Nguyen

(57) ABSTRACT

The present invention discloses an antenna adapted for use in a wireless network device. The antenna includes a base and two antenna portions. Each antenna portion includes a radiation section and a ground section. The ground sections of the two antenna portions are connected with the same base and substantially perpendicular to the base. The radiation section is connected with the ground section and substantially parallel to the base with a difference in height formed between the radiation section and the base. The antenna is a single component integrally formed by stamping an electrically conductive thin metal plate, which not only facilitates fabrication thereof, but also the assembly of the antenna to a substrate of the wireless network device, thereby increasing the gain of the wireless network device along a vertical direction.

12 Claims, 8 Drawing Sheets

SYMMETRICAL UNI-PLATED ANTENNA AND WIRELESS NETWORK DEVICE HAVING THE SAME

BACKGROUND OF INVENTION

1. Field of the Invention

The present invention relates to antennas, and more particularly, to an integrally formed and symmetrical plated inverted-F antenna (PIFA) adapted for use in wireless network devices, and a wireless network device with the antenna.

2. Description of the Prior Art

Referring to FIG. 1, which is a perspective view of a typical wireless network device 10. The wireless network device 10 usually includes a main body 11, an internal circuit apparatus 12 located inside the main body 11, a connector portion 13 located at one end of the main body 11 for connecting an external main unit (not shown), and a radio signal receive/transmit portion 14 located at an end of the main body 11 opposing the connector portion 13. Generally, the radio signal receive/transmit portion 14 is provided with an outer casing that is made of a non-metal material. When the wireless network device 10 is connected to the external main unit, the radio signal receive/transmit portion 14 must be exposed outside of the external main unit so as to effectively receive and transmit radio signals.

Referring to FIG. 2, which is a schematic view of a conventional internal circuit apparatus 20 of wireless network device. The conventional internal circuit apparatus 20 of wireless network device includes a substrate 21, a control circuit 22 located on the substrate 21, a ground portion 23 covering a predetermined area of the substrate 21, and an antenna unit 24 electrically connected to the control circuit 22. The conventional antenna unit 24 illustrated in FIG. 2 includes a first antenna 241 and a second antenna 242 located at two lateral sides of the substrate 21, respectively. Since the antenna unit of this conventional internal circuit apparatus 20 is designed as printed antenna printed on the substrate 21, by making different shapes of the first antenna 241 and the second antenna 242, the antenna unit can achieve a better radiation field profile and higher gain on an X-Y plane (horizontal plane), but there is little room for further improvement of antenna gain along a vertical Z direction. However, the design of current wireless network device tends to be vertical stand type, so as to reduce the space occupied by the wireless network device, as well as to make the appearance of the wireless network device more modern and high-tech. It is obvious that the conventional printed antenna cannot meet the requirement for the vertical stand type wireless network device due to the poor gain along the vertical Z direction.

For example, referring to FIG. 3, which is a chart showing a radiation field profile measured on an X-Y plane of the first antenna of the conventional antenna unit 24 as shown in FIG. 2. From the radiation field profile of FIG. 3, it can be seen that the peak gain of the first antenna 241 along the vertical direction is only −15.89 dBi, which is apparently lower than the minimum standard accepted by consumers (a general requirement is that the gain should be at least greater than −10 dBi). Thus, there is still room for improvement regarding to the design of antenna, which is also critically important for meeting the need for high performance antenna from consumers.

SUMMARY OF INVENTION

A first objective of the present invention is to provide a symmetrical uni-plated antenna that facilitates fabrication and reduces cost by using a stamping process to integrally and simultaneously form two side antenna portions.

A second objective of the present invention is to provide an antenna adapted for use in a wireless network device, which can be quickly assembled to the wireless network device by means of an insert type design of antenna, and which has an antenna radiation field profile that increases the gain along a vertical direction and reduces dead angle.

In order to achieve the aforementioned objectives, the antenna of the present invention includes a base and two antenna portions. Each antenna portion includes a radiation section and a ground section. The ground sections of the two antenna portions are connected with the same base and substantially perpendicular to the base. The radiation section is connected with the ground section and substantially parallel to the base with a difference in height formed between the radiation section and the base. The antenna is a single component integrally formed by stamping an electrically conductive thin metal plate, which not only facilitates fabrication thereof, but also the assembly of the antenna to a substrate of the wireless network device, thereby increasing the gain of the wireless network device along a vertical direction. The antenna further comprises at least one inserting portion, and the inserting portion is connected with the base and substantially perpendicular to the base.

Preferably, the antenna of the present invention is configured to be inserted into a substrate. The substrate further comprises:

at least one opening, the opening being positioned corresponding to the inserting portion, wherein when the inserting portion is inserted and mounted into the opening, the base of the antenna is in contact with a top surface of the substrate;

a control circuit configured to provide a wireless network transmitting function;

a ground portion electrically grounded and electrically coupled to the base; and at least one feed line coupled between the control circuit and the antenna portions.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION

Figure 1:
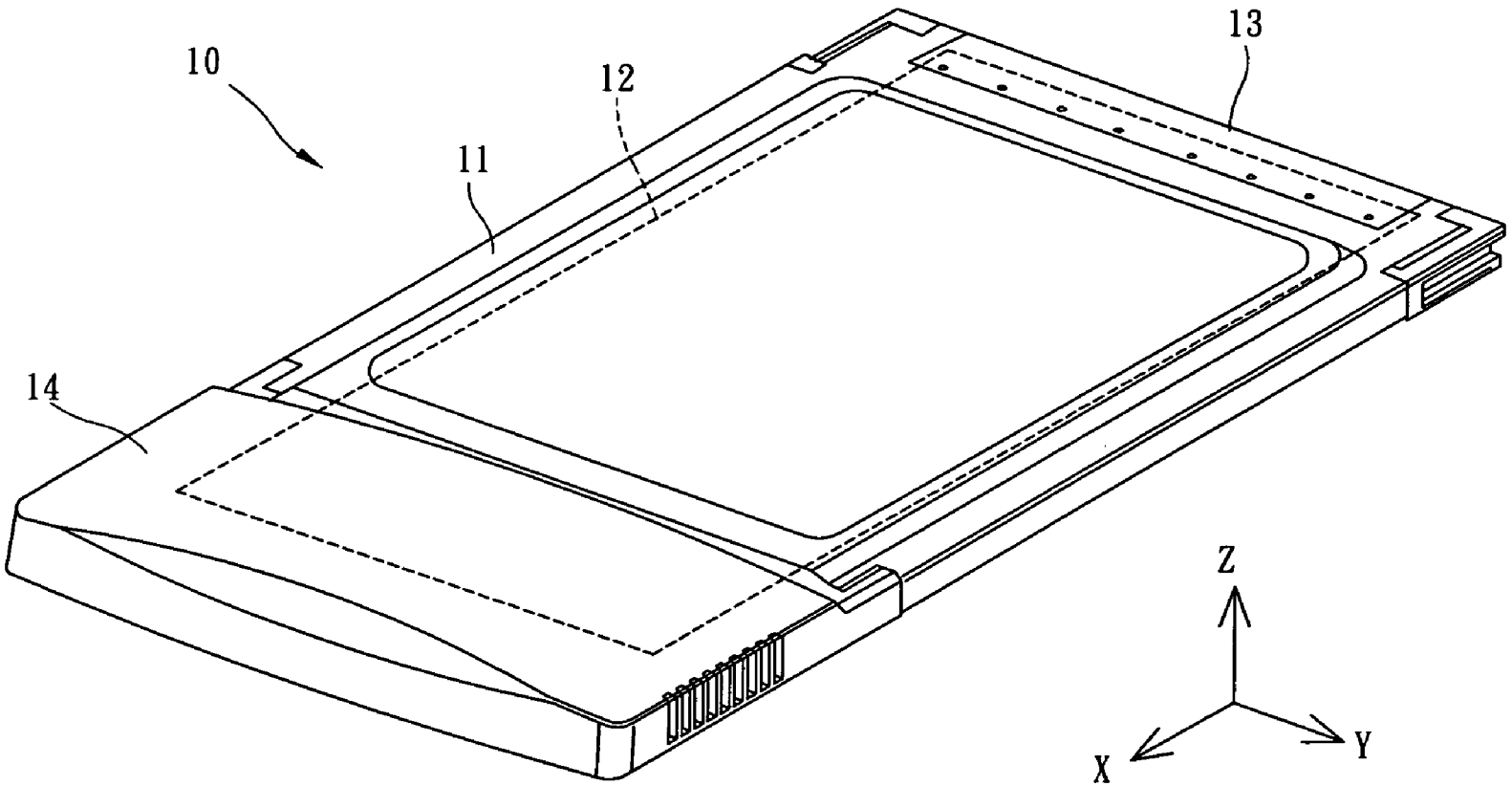
FIG. 1 (PRIOR ART)
FIG. 1 is a perspective view of a typical wireless network device.

The main principle of the symmetrical uni-plated antenna and the wireless network device having the antenna according to the present invention is that, a plated inverted-F antenna (PIFA) is integrally formed by using a stamping process in which two side antenna portions are simultaneously formed, and the antenna can be quickly assembled to a substrate of the wireless network device. This not only achieves a higher gain along a vertical direction, but also facilitates fabrication and assembly, and further reduces cost.

Referring to FIGS. 4 through 7, which are the perspective view, side view, top view and bottom view of a symmetrical uni-plated antenna in accordance with a preferred embodiment of the present invention. The symmetrical uni-plated antenna 5 of the present invention is a single component integrally formed by using a stamping process to bend an electrically conductive thin metal plate (for example, copper, iron, aluminum). Therefore, the antenna 5 is of an even thickness d, except at the bended areas. The single antenna 5 includes a base 51 and two antenna portions 52, 53. In this preferred embodiment, the two antenna portion 52, 53 are located at two sides of the base 51 in a symmetrical manner, and the geometric shapes of the antenna portions 52, 53 substantially correspond to each other, therefore, only the structure of the antenna portion 52 will be described from hereafter, and the structure of the other antenna portion 53 will not be described further.

The antenna portion 52 further includes a ground section 521, a signal section 522 and a radiation section 523. The ground section 521 is connected with the base 51, formed by bending the base 51, and is substantially perpendicular to the base 51. The radiation section 523 is connected with the ground section 521 and is positioned substantially in parallel with the base 51 with a difference in height h formed between the radiation section 523 and the base 51; in this embodiment, the difference in height h is preferable to be within the range from 3 to 4.5 mm. In the preferred embodiment of the present invention, the radiation section 523 defines a slot 524 with a predetermined shape, and the slot 524 has an opening 525 positioned substantially corresponding to the ground section 521. The slot 524 is generally V-shaped, so that the radiation section 523 forms an end section 526. By configuring the predetermined shape and size of the radiation section 523, the radiation section 523 can change the bandwidth of the application frequency band. The signal section 522 is connected with the radiation section 523. The signal section 522 is substantially perpendicular to the base 51, and located at a same side where the ground section 521 resides. The signal section 522 is spaced from the ground section 521 at a distance. The signal section 522 further includes a free end 527 separate from the base 51.

In this preferred embodiment, the antenna 5 further includes at least one inserting portion 54. The inserting portion 54 is connected with the base 51 and substantially perpendicular to the base 51. Preferably, the number of the inserting portions 54 is three and the inserting portions 54 are located at vertexes of an imaginary triangle. Alternatively, the number of the inserting portions 54 may be one, two, four or above. It will be apparent to those skilled in the art that variation in the number of the inserting portions can be made in view of the above description without departing from the principle of the present invention, or out of the scope or spirit of the invention, which will not be described herein in further detail.

Figure 8:
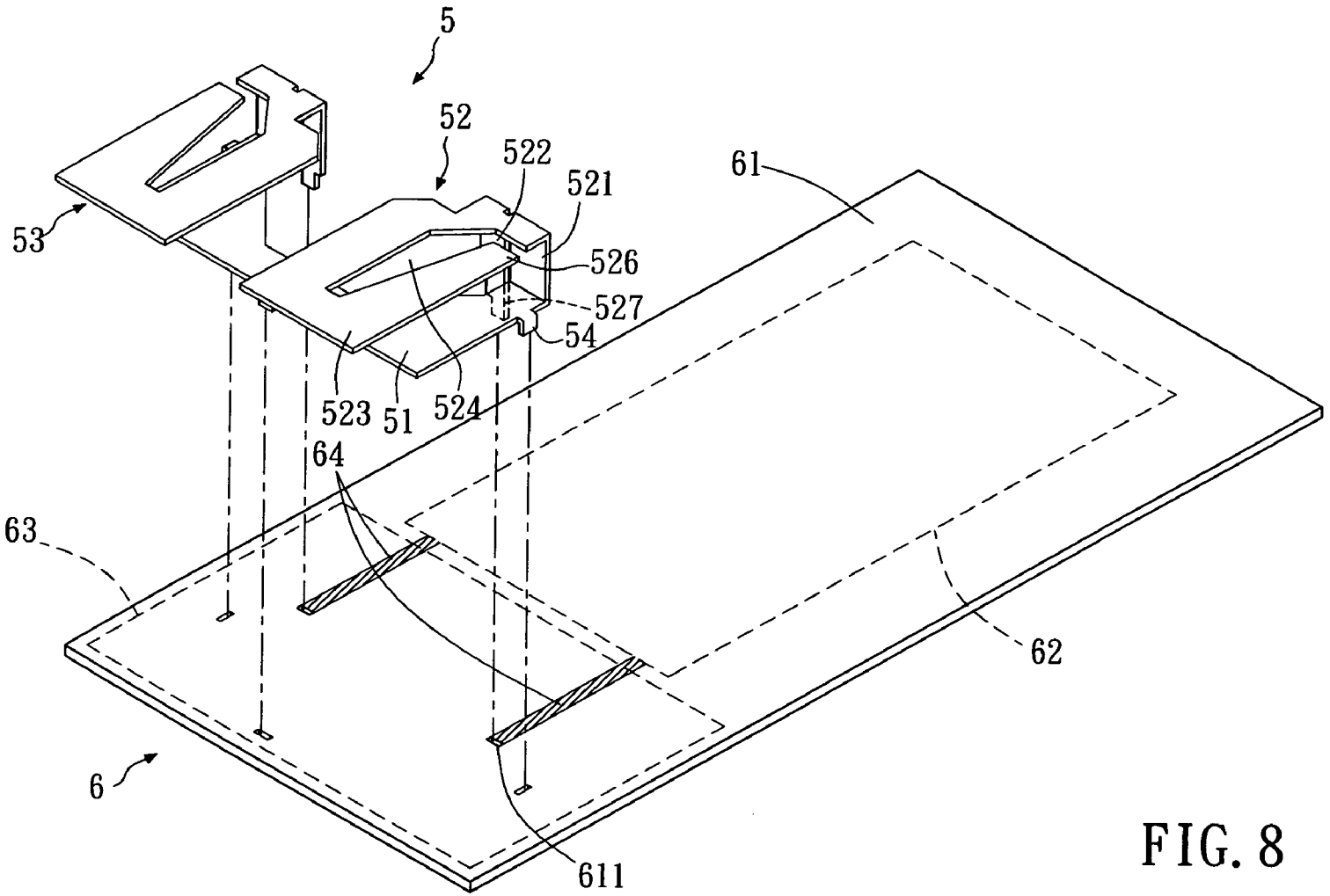
FIG. 8 is a schematic view showing a preferred embodiment of an internal circuit apparatus of a wireless network device having the antenna of the present invention.

Referring to FIG. 8, which is a schematic view showing a preferred embodiment of an internal circuit apparatus of a wireless network device with the antenna of the present invention. The wireless network device 6 of the present invention includes a substrate 61, a control circuit 62, a ground portion 63, at least one feed line 64, and the antenna 5 of the present invention. The substrate 61 is made of a dielectric material and made into a substantially low-profile rectangular substrate 61. The substrate 61 has at least one opening 611 defined therein, and in a preferred embodiment, the number of the openings 611 is three and the openings 611 are located at vertexes of an imaginary triangle. The control circuit 62 is formed on the substrate 61, and includes circuit layout, a plurality of IC components and electronic components and is capable of providing a wireless network transmitting function. The control circuit 62 can use conventional technology and is not a feature of the present invention; therefore, the configuration of the control circuit 62 is not described herein in detail.

The ground portion 63 is electrically grounded and covers at least a part of the area of the substrate 61. In this preferred embodiment, most elements of the antenna 5 are the same as or similar to the ones in the foregoing embodiment, therefore, same elements will be given same names and same reference numbers. The inserting portions 54 of the antenna 5 are positioned corresponding to the openings 611 and are inserted to corresponding openings 611, thus making the base 51 contact with a top surface of the substrate 61; the ground section 521 of each of the antenna portions 52, 53 is in contact with the ground portion 63 to provide an electrical grounding function; and the free end 527 of the signal section 522 is coupled to the feed line 64 to provide a signal transmit function.

Figure 2:
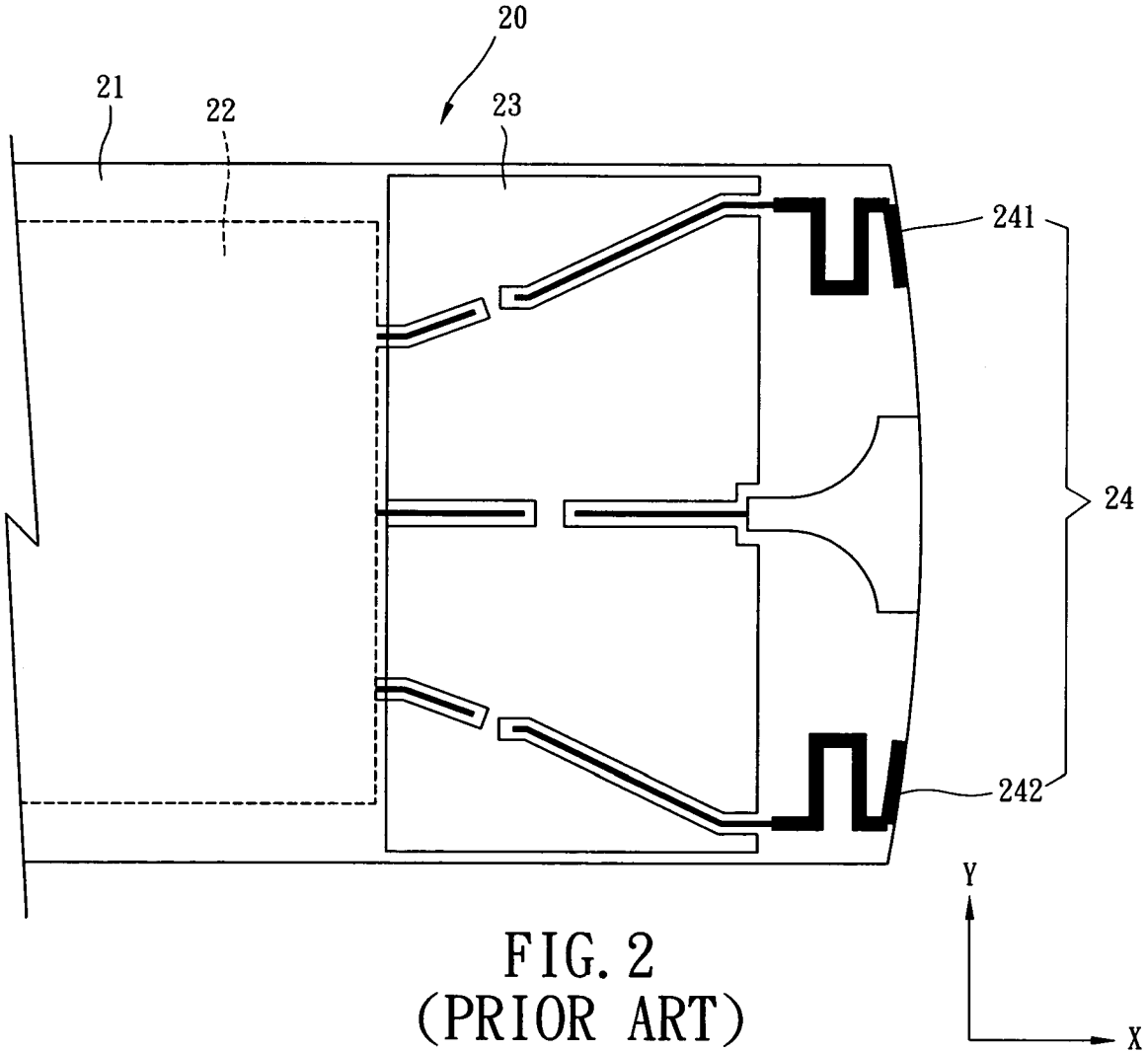
FIG. 2 (PRIOR ART)
FIG. 2 is a schematic view of a conventional internal circuit apparatus of the wireless network device.
Figure 3:
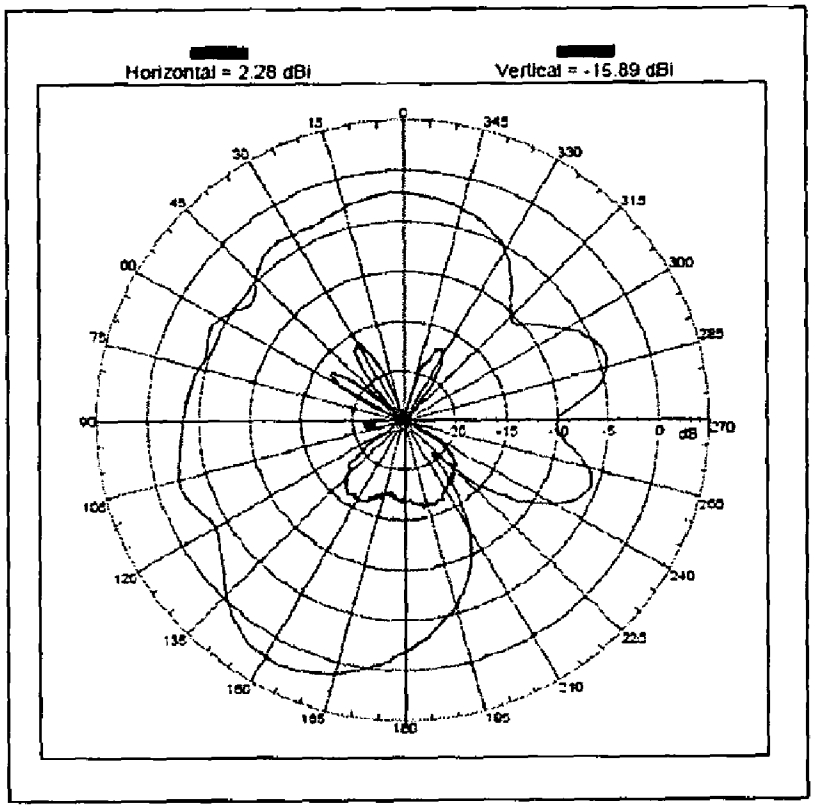
FIG. 3 (PRIOR ART)
FIG. 3 is a chart showing a radiation field profile measured on an X-Y plane of the first antenna of the conventional antenna unit as shown in FIG. 2.
Figure 4:
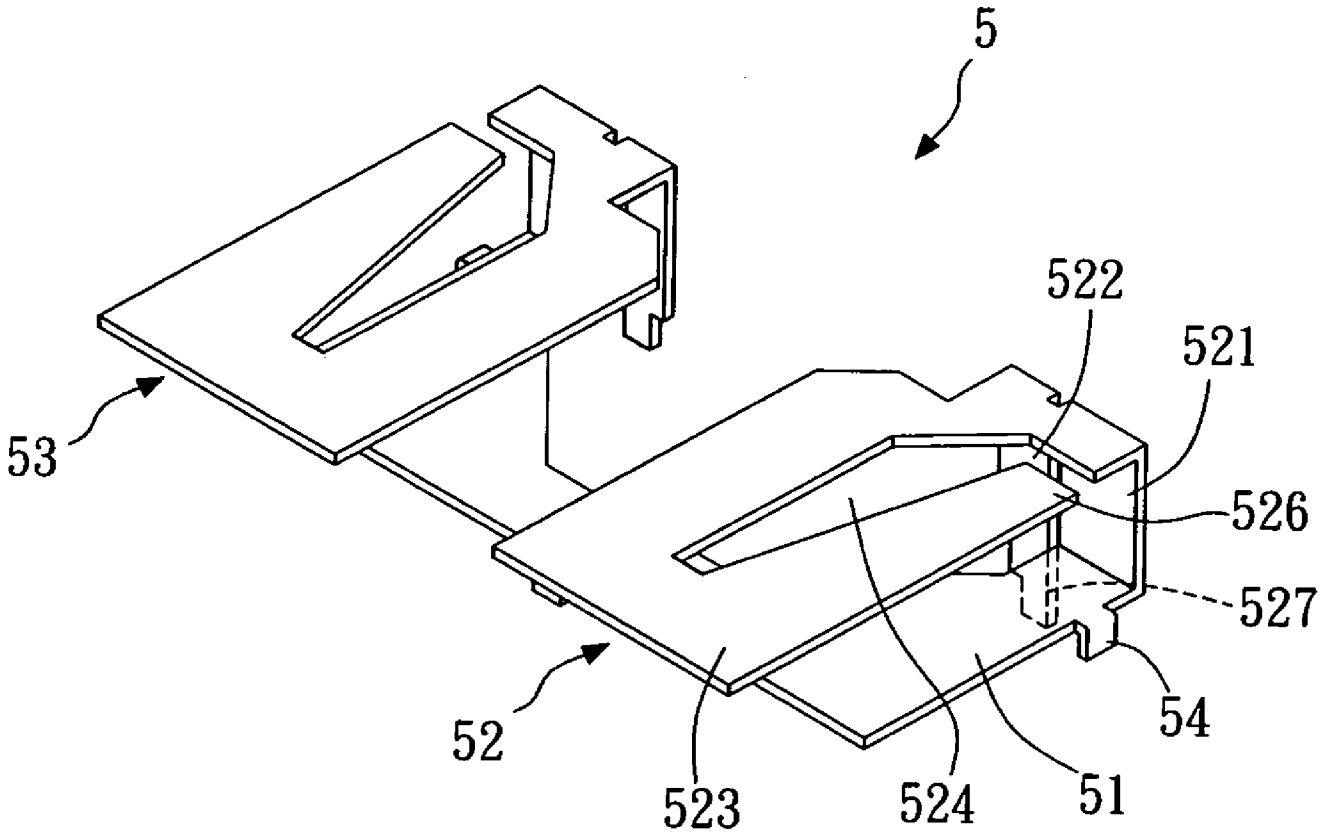
FIG. 4 is a perspective view of a symmetrical uni-plated antenna in accordance with a preferred embodiment of the present invention.
Figure 7:
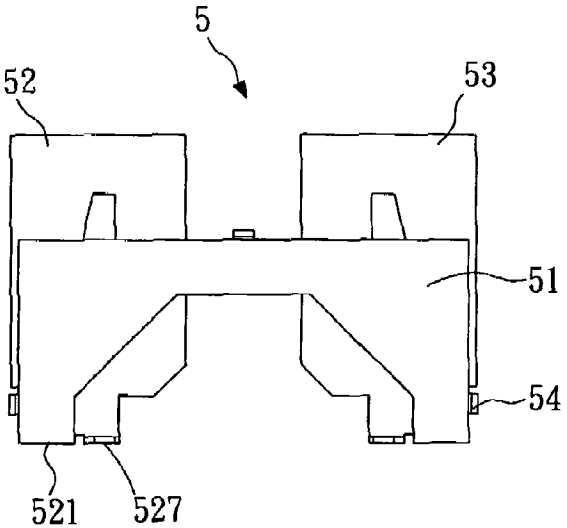
FIG. 7 is a bottom view of the symmetrical uni-plated antenna in accordance with the preferred embodiment of the present invention.
Figure 5:
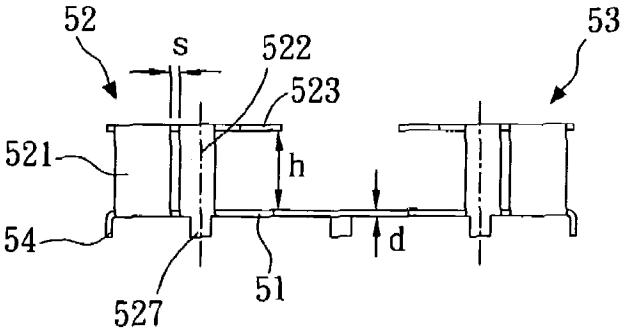
FIG. 5 is a side view of the symmetrical uni-plated antenna in accordance with the preferred embodiment of the present invention.
Figure 6:
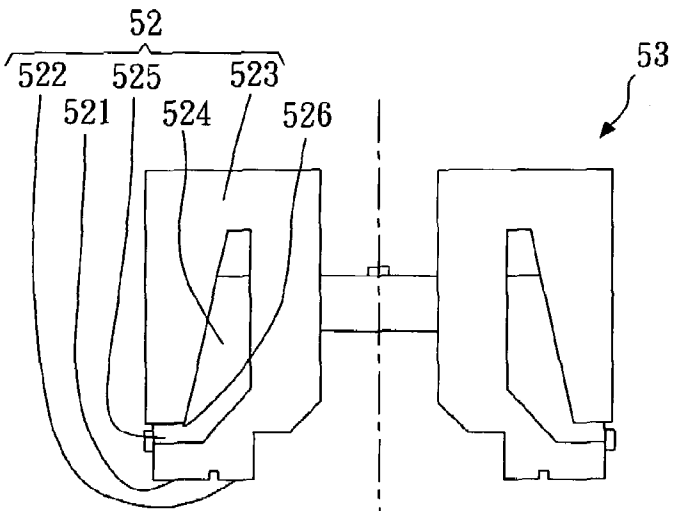
FIG. 6 is a top view of the symmetrical uni-plated antenna in accordance with the preferred embodiment of the present invention.
Figure 9:
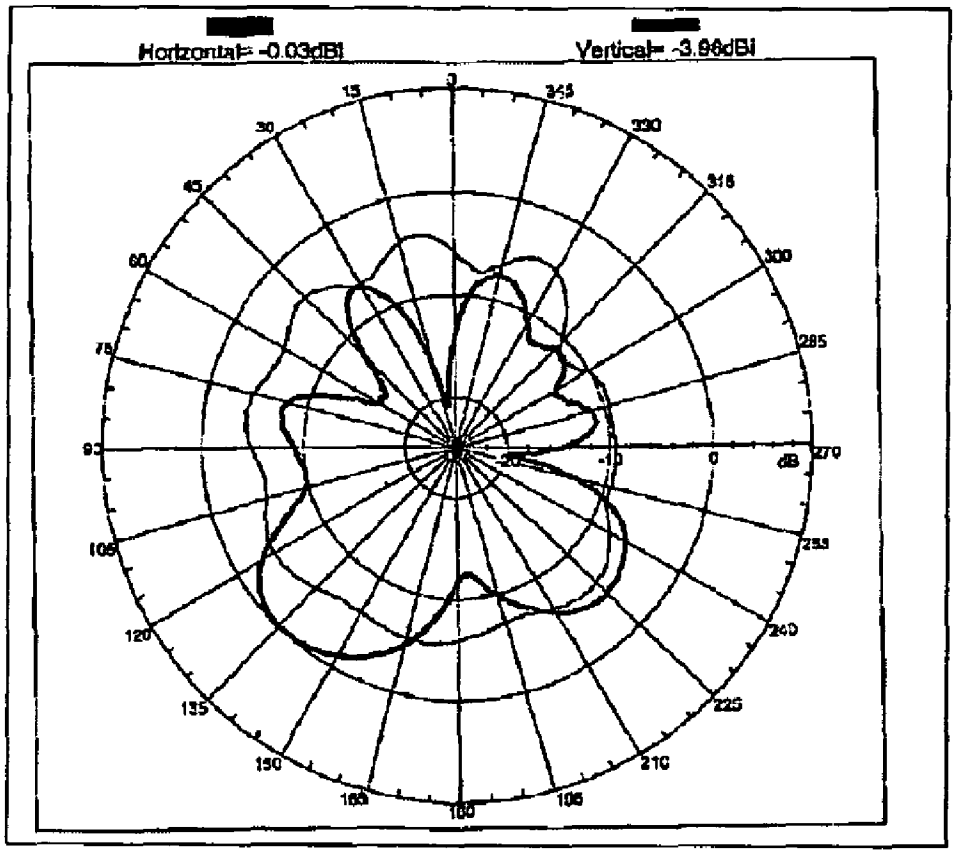
FIG. 9 is a chart showing a radiation field profile of the antenna portions of the antenna of the present invention as shown in FIG. 8 measured on an X-Y plane.
Figure 10:
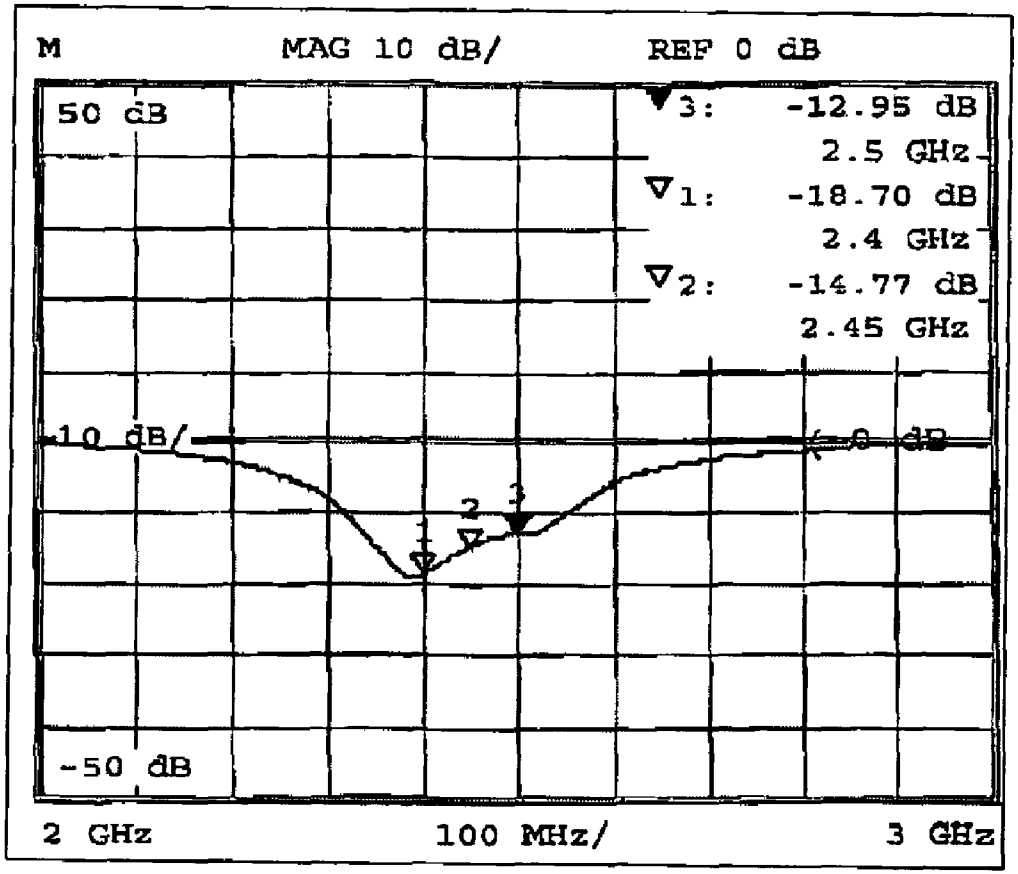
FIG. 10 is a chart showing measurements of input return loss of the antenna portion of the antenna of the present invention as shown in FIG. 8.

Referring to FIG. 9, which is a chart showing a radiation field profile of the antenna portions of the antenna of the present invention as shown in FIG. 8 measured on an X-Y plane. From the radiation field profile of FIG. 9, it can be seen that the gain of the antenna portion 52 along the vertical direction can be as high as −3.96 dBi, which is apparently much higher than the gain −13.27 dBi of the conventional technology as shown in FIGS. 2 and 3. Referring then to FIG. 10, which is a chart showing measurements of input return loss of the antenna portion of the antenna of the present invention as shown in FIG. 8. From FIG. 10, it can be seen that the input return loss of the antenna of the present invention is less than −10 dB, which meets the market need for high performance antenna design. It is understood that the antenna 5 of the present invention not only provides better wireless communication quality and transmission efficiency along the vertical direction than conventional technologies, but also facilitates fabrication and reduces cost by using the stamping process to integrally and simultaneously form the two side antenna portions.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A symmetrical uni-plated antenna comprising:

a base;

two antenna portions, each of the antenna portions including a radiation section and a ground section, the ground section connected with the base and substantially perpendicular to the base, the radiation section connected with the ground section and substantially parallel to the base with a difference in height formed between the radiation section and the base, wherein the antenna further comprises at least one inserting portion, and the inserting portion is connected with the base and substantially perpendicular to the base.

2. The antenna in accordance with claim 1, wherein the antenna is a single component integrally formed by stamping an electrically conductive thin metal plate.

3. The antenna in accordance with claim 1, wherein the difference in height is within the range from 3 to 4.5 mm.

4. The antenna in accordance with claim 1, wherein the each of the antenna portions further comprises a signal section, the signal section is connected with the radiation section and substantially perpendicular to the base with a distance formed between the signal section and the ground section, and the signal section further comprises a free end separate from the base.

5. The antenna in accordance with claim 1, wherein the antenna is configured to be inserted into a substrate, the substrate further comprises:

at least one opening, the opening being positioned corresponding to the inserting portion, wherein when the inserting portion is inserted and mounted into the opening, the base of the antenna is in contact with a top surface of the substrate;

a control circuit configured to provide a wireless network transmitting function;

a ground portion electrically grounded and electrically coupled to the base; and at least one feed line coupled between the control circuit and the antenna portions.

6. The antenna in accordance with claim 1, wherein the radiation section defines a slot therein with a predetermined shape so that the radiation section forms an end section, and the slot has an opening.

7. A wireless network device comprising:

a substrate made of a dielectric material, the substrate having at least one opening defined therein;

a control circuit formed on the substrate and configured to provide a wireless network transmitting function;

a ground portion electrically grounded and covering at least a part of the area of the substrate;

at least one feed line extending through the ground portion and coupled to the control circuit; and an antenna, the antenna further comprising:

a base;

at least one inserting portion, each positioned corresponding to a respective opening, the at least one inserting portion connected with the base and substantially perpendicular to the base, wherein when the inserting portion is inserted and mounted into the opening, the base of the antenna is in contact with a top surface of the substrate; and two antenna portions, each of the antenna portions including a radiation section, a ground section and a signal section, the ground section connected with the base, the radiation section connected with the ground section and substantially parallel to the base with a difference in height formed between the radiation section and the base, the signal section connected with the radiation section and including a free end coupled to the at least one feed line.

8. The wireless network device in accordance with claim 7, wherein the antenna is a single component integrally formed by stamping an electrically conductive thin metal plate.

9. The wireless network device in accordance with claim 7, wherein the difference in height is within the range from 3 to 4.5 mm.

10. The wireless network device in accordance with claim 7, wherein the radiation section defines a slot therein with a predetermined shape so that the radiation section forms an end section, and the slot has an opening.

11. The wireless network device in accordance with claim 7, wherein the signal section and the ground section are each perpendicular to the base, and spaced at a distance from each other.

12. The wireless network device in accordance with claim 7, wherein the ground section is in contact with the ground portion.

* * * * *